US009451838B2

(12) United States Patent
Cayce et al.

(10) Patent No.: US 9,451,838 B2
(45) Date of Patent: Sep. 27, 2016

(54) SNAP-IN CARD TOP RISER

(71) Applicant: HALLMARK CARDS, INCORPORATED, Kansas City, MO (US)

(72) Inventors: Craig William Cayce, Kansas City, MO (US); Brian Lee Wegstein, Washburn, IL (US)

(73) Assignee: HALLMARK CARDS, INCORPORATED, Kansas City, MO (US)

( * ) Notice: Subject to any disclaimer, the term of this patent is extended or adjusted under 35 U.S.C. 154(b) by 28 days.

(21) Appl. No.: 14/310,595

(22) Filed: Jun. 20, 2014

(65) Prior Publication Data

US 2015/0366375 A1 Dec. 24, 2015

(51) Int. Cl.
*A47F 7/00* (2006.01)
*A47F 7/14* (2006.01)

(52) U.S. Cl.
CPC ..... *A47F 7/147* (2013.01); *A47F 7/145* (2013.01)

(58) Field of Classification Search
CPC .. A44B 18/0053; A44B 19/16; A47B 57/40; A47B 57/48; A47F 5/10; A47F 5/101; A47F 7/14; A47F 7/143; A47F 7/144; A47F 7/145; A47F 7/146; A47F 7/147
USPC ..... 211/45, 46, 50, 52, 55, 128.1; 40/124, 40/124.2, 124.4
See application file for complete search history.

(56) References Cited

U.S. PATENT DOCUMENTS

| | | | | |
|---|---|---|---|---|
| 2,354,485 | A * | 7/1944 | Slaughter | A44B 19/16 138/128 |
| 2,532,600 | A * | 12/1950 | Broersma | A47F 7/145 211/128.1 |
| 2,710,473 | A | 6/1955 | Kress et al. | |
| 3,507,064 | A | 4/1970 | Hammero | |
| 4,182,087 | A * | 1/1980 | Schall | E02D 5/03 4/506 |
| 4,949,849 | A * | 8/1990 | Hardy | A47F 7/145 211/128.1 |
| 6,422,403 | B1 | 7/2002 | Woolnough et al. | |
| 6,439,399 | B1 * | 8/2002 | Wegstein | A47F 7/145 211/128.1 |
| 7,987,999 | B2 * | 8/2011 | Weigand | A47F 5/0884 211/55 |
| 8,959,871 | B2 * | 2/2015 | Parenti | E04C 3/36 52/170 |
| 2010/0163501 | A1 * | 7/2010 | Berry | A47F 7/0014 211/55 |

FOREIGN PATENT DOCUMENTS

| | | | | |
|---|---|---|---|---|
| GB | 1482997 A * | 8/1977 | | A47F 5/00 |
| WO | WO 2014116720 A1 * | 7/2014 | | A44B 19/16 |

OTHER PUBLICATIONS

Canadian Office Action dated Mar. 8, 2016 in Application No. 2,876,610, 3 pages.

* cited by examiner

*Primary Examiner* — Joshua Rodden
(74) *Attorney, Agent, or Firm* — Shook, Hardy & Bacon L.L.P.

(57) ABSTRACT

A snap-in card top riser is provided having a riser and a display module. The riser has a hook profile that is adapted to be received into a channel on the display module so that the riser is secured to the display module in a manner that restricts removal of the riser from the display module. The channel has one or more tabs that are configured to cause the hook profile to compress while the tabs are engaging with the hook profile. The hook profile, once fully received into the channel, returns to an original or uncompressed position to prevent removal of the hook profile from the channel.

19 Claims, 3 Drawing Sheets

SNAP-IN CARD TOP RISER

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates generally to an improved display module for the display of greeting cards.

BACKGROUND

Greeting cards are typically displayed in shelves that can be made in different ways. Traditionally, stores have metal frames or "fixtures" onto which opaque molded plastic sections are mounted. Clear plastic shelves may then be coupled to the display modules to provide the rows upon which the greeting cards are to be placed for display to consumers. Many times, the shelves are not only difficult to mount, but are also difficult to remove. Further, the shelves and the metal frames are expensive to manufacture because of the thickness of the materials used in their manufacture.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention are directed to a snap-in card top riser having a riser with a hook profile, and a display module having a channel that is configured to receive the riser. The channel has one or more tabs that make contact with the hook profile as the riser is engaging with the channel. In one instance, the hook profile compresses as it is engaging with the tabs, and returns to its original position or shape once it is substantially received into the channel. Once substantially received into the channel, the riser is locked into place and remains in a relatively consistent position relative to the display module until removed from the display module. In some embodiments, multiple risers are utilized in a single display module, such as being adjacent to one another, and as such, the display module would also have multiple channels, such as the same quantity of channels as risers. This allows for a greater quantity of greeting cards or other items to be stored in the card top riser.

BRIEF DESCRIPTION OF THE SEVERAL VIEWS OF THE DRAWINGS

The present invention is explained in more detail with reference to the embodiment illustrated in the attached drawing figures, in which like reference numerals denote like elements, in which FIGS. 1-6 illustrate but one possible embodiment of the present invention, and in which:

FIG. 1 is a front perspective view of a snap-in card top riser, in accordance with an embodiment of the present invention;

FIG. 2 is an enlarged fragmentary view of a portion of the snap-in card top riser of FIG. 1, with a lowermost riser in an exploded position;

FIG. 3 is a front right perspective view of at least a portion of a snap-in card top riser, in accordance with an embodiment of the present invention;

FIG. 4 is a rear perspective view of the snap-in card top riser of FIG. 2;

FIG. 5 is a cross sectional view of the snap-in card top riser of FIG. 1 taken along the line 5-5; and FIG. 6 is an enlarged fragmentary view of the snap-in card top riser of FIG. 5 taken in the area 6.

DETAILED DESCRIPTION

As mentioned, a snap-in card top riser may be used, for instance, in a commercial setting, such as a retail store, to hold greeting cards that are for sale. Aspects provided herein provide for card display modules that are more cost efficient to manufacture, in part because of the reduction of material used in comparison to traditional card display modules. For instance, the retaining risers and the display modules, as further described herein, may be thinner than traditional risers and card display modules. In one embodiment, the display module is 30% thinner and the risers are 40% thinner than traditional card display modules.

In one aspect, a snap-in card top riser is provided and comprises a riser having a hook profile, and a display module having a channel that is adapted to receive the hook profile to secure the riser to the display module. The channel has one or more tabs that are configured to cause the hook profile to compress while the one or more tabs are engaging with the hook profile, and the hook profile returns to an uncompressed position when the hook profile is substantially or fully received into the channel.

In a second aspect, a snap-in card top riser is provided and comprises a riser having an upper panel and a lower panel, the lower panel extending from a first edge of the upper panel, the lower panel having a first edge from which a hook profile extends. The snap-in card top riser also comprises a display module having at least an upper section, a middle section, and a channel that is formed at an intersection of the upper section and the middle section. The channel has one or more tabs and is configured to receive the hook profile. The hook profile is configured to compress when engaging with the one or more tabs of the channel, and the hook profile returns to an original position when substantially or fully engaged with the channel.

A third aspect is directed to a snap-in card top riser that comprises a riser having a hook profile, and a display module having a channel that is adapted to receive the hook profile. The channel has one or more tabs that are configured to compress when the hook profile is engaging with the one or more tabs. The one or more tabs return to an uncompressed position when the hook profile is received into the channel.

Figure 1:
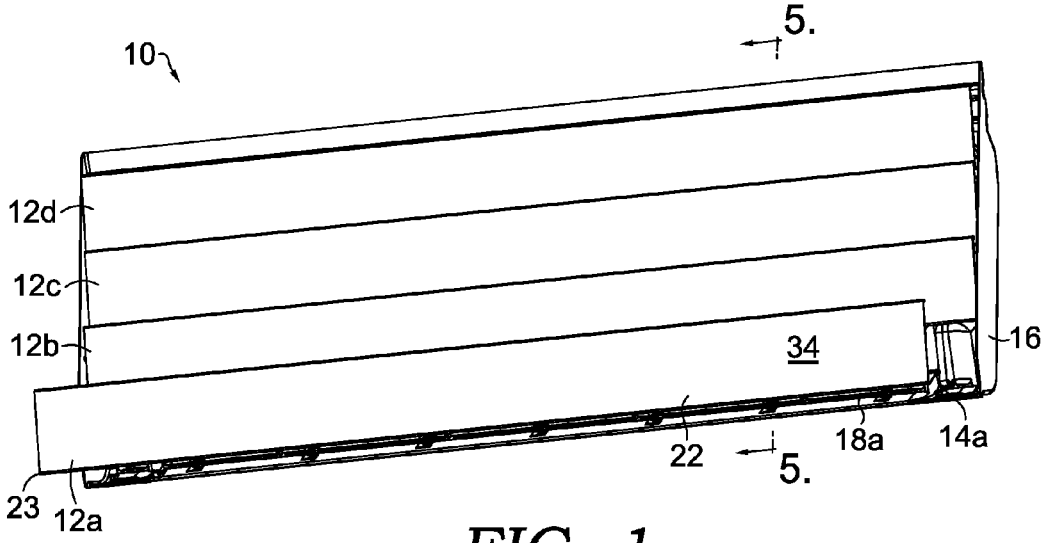

Referring now to the drawings in more detail, wherein like reference characters designate like parts throughout the different views, and initially to FIG. 1, a front view of a snap-in card top riser 10 is depicted, in accordance with an embodiment of the present invention. The snap-in card top riser 10 of FIG. 1 includes multiple risers, shown here as risers 12*a*, 12*b*, 12*c*, and 12*d*. While four risers are illustrated in the embodiment of FIG. 1, it is contemplated that any quantity of risers may be utilized. The quantity of risers utilized may, for instance, be determined by how tall the card display module is to stand and/or how many greeting cards the card top riser is to hold. As will be shown more clearly in other figures herein, each riser may include a hook profile. Riser 12*a*, also referred to herein as a first riser, has a hook profile 14*a*, also referred to herein as a first hook profile. The card top riser may also include a second riser, such as riser 12*b*, having a second hook profile, etc. The first and second risers may correspond to first and second channels into which the risers are received.

Figure 3:
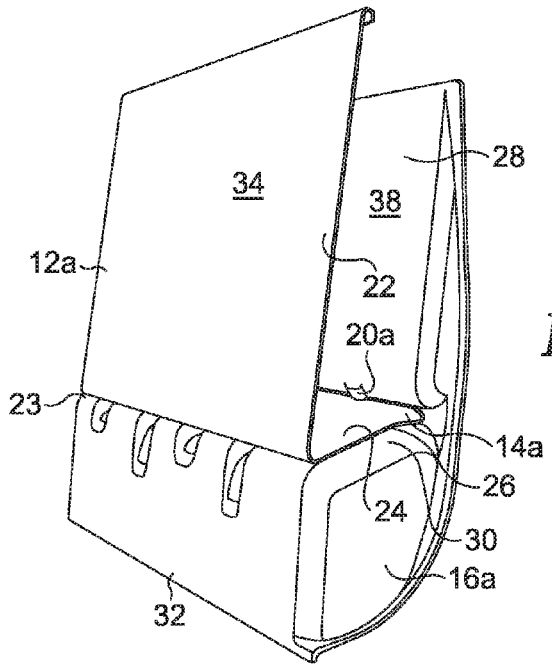
Figure 4:
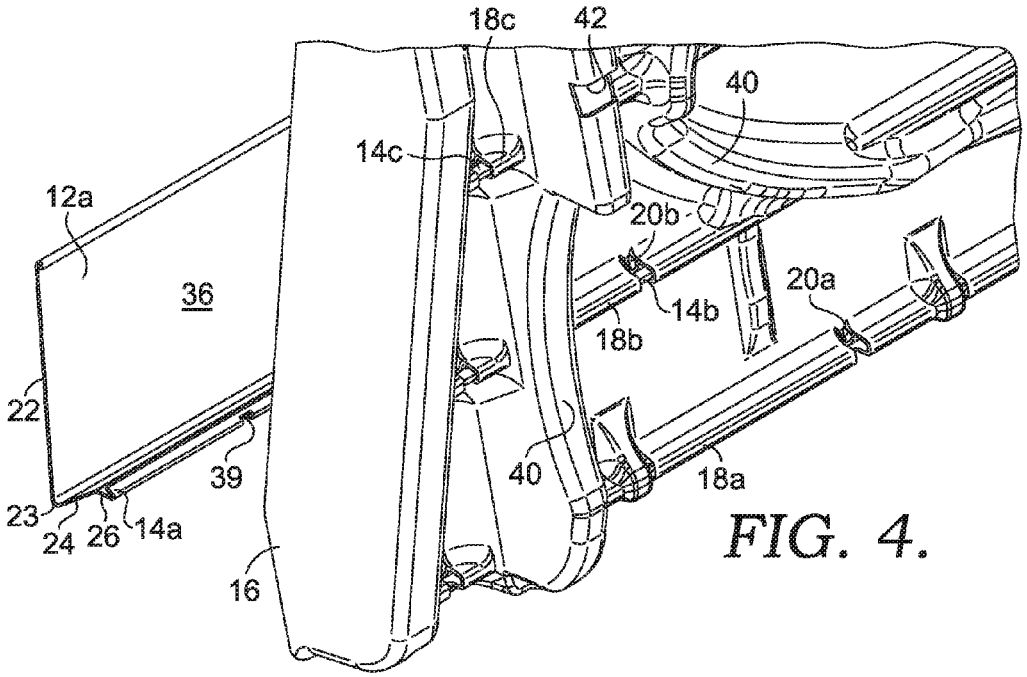

In one embodiment, each riser (items 12*a*-12*d*) comprises an upper panel 22 and a lower panel 24, the lower panel 24 extending from the upper panel 22. The upper panel 22 has a front surface 34 and a back surface 36 (shown in FIG. 4). The hook profile may extend from a first edge 23 of the lower panel, or at an edge of the lower panel farthest from the upper panel. The lower panel and the first edge of the lower panel are illustrated in FIGS. 3 and 4 herein. The hook profile, such as hook profile 14*a* shown in FIG. 1, is configured to engage with or be received into a portion of a display module 16. Although not specifically numbered in the figures, each riser has similar parts, including an upper panel having a first edge, and a lower panel also having a first edge.

The display module 16 includes a channel 18*a*, which can be seen in FIG. 1. The channel 18*a* runs laterally across the display module 16 and is configured to receive the hook profile 14*a* of the riser 12*a*. Additional channels 18*b*, 18*c*, and 18*d* are parallel to channel 18*a* and are visible in FIG. 5. In one embodiment, the quantity of risers corresponds to the quantity of channels, as each riser is received into a channel. The channels, such as the channel 18*a*, have grooves formed therein that are trimmed to create tabs that lock the risers into place. As such, each channel may comprise one or more tabs, the tabs being spaced apart laterally along the channel. In one instance, the tabs are equidistant from one another. In the illustrated embodiment, and in particular with reference to FIG. 5, the display module 16 includes tabs 20*a*, 20*b*, 20*c*, and 20*d*, which are located in channels 18*a*, 18*b*, 18*c*, and 18*d*, respectively. While only one tab along a single channel is labeled in the figures herein, it is contemplated that one or more tabs are located along each channel in order to secure the risers to the display module. For example, the tabs along a first channel, or channel 18*a*, may be referred to as a first set of tabs, while the tabs along a second channel may be referred to as a second set of tabs, such that the first set of tabs engage with the first hook profile that compresses, while the second set of tabs are engaging with the second hook profile. In one embodiment, the quantity of tabs across the length of each channel is selected to provide strength to the display module while utilizing thinner materials, as previously discussed.

In one embodiment, when a hook profile (items 14*a*-14*d*) is engaging with a channel (items 18*a*-18*d*), the tabs (items 20*a*-20*d*) force the hook profile to compress in order for the hook profile to be fully engaged with the channel. Once the hook profile of the riser is seated into the channel, the hook profile returns to its original position, or non-compressed position, thereby locking the riser into the display module. In yet another embodiment, instead of or in addition to the hook profile compressing during engagement with the tabs, the tabs may compress, and subsequently return to their original or non-compressed positions. As such, it is contemplated that one or both of the tabs of the display module and the hook profile of the riser compress during engagement. As used herein, engagement refers to both the contact of a hook profile with a channel, and the contact of a hook profile with the tabs.

Figure 2:
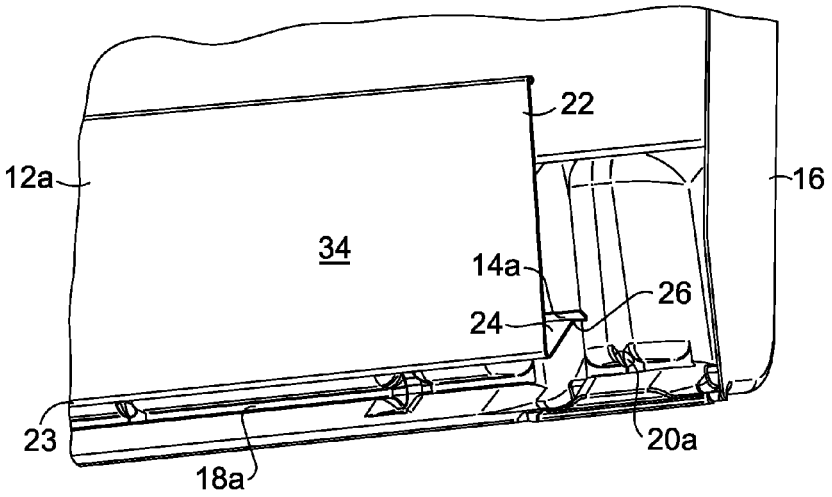

Turning now to FIG. 2, an enlarged fragmentary view of a portion of the snap-in card top riser of FIG. 1 is illustrated, in accordance with an embodiment of the present invention. Many of the same components of the snap-in card top riser 10 of FIG. 1 are illustrated here. For instance, one of the risers, riser 12*a*, is illustrated in an exploded view where it is not yet coupled with the display module. The riser 12*a* has an upper panel 22, having a first or lower edge 23, and a lower panel 24, having a first or distal edge 26. The upper panel 22 has a front surface 34 and a rear surface 36 (FIG. 4). Generally, the front surface 34 of the upper panel 22 faces away from the display module 16. Further, the riser 12*a* includes a hook profile 14*a* that extends from the first edge 26 of the lower panel 24. Similarly, as illustrated in FIG. 2, the display module 16 has a generally horizontal lateral channel 18*a* into which the hook profile 14*a* is received. The display module 16 also includes a plurality of tabs, including tab 20*a*.

FIG. 3 is a perspective view of at least a portion of a snap-in card top riser, in accordance with an embodiment of the present invention, in an orientation to view it more from the right side. As mentioned, a snap-in card top riser may have any quantity of risers depending on, for instance, the quantity of greeting cards that the card top riser is to hold and how tall the card top riser is to stand from the ground. Here, one riser, or riser 12*a*, is illustrated. However, a single riser is illustrated as just one example of the quantity of risers utilized in a card top riser, and it is contemplated that any other quantity of risers could also be utilized. In FIG. 3, the riser 12*a* includes an upper panel 22, having a first edge 23 and a front surface 34, and a lower panel 24, having a first edge 26, the lower panel 24 extending from the first edge 23 of the first surface 22. In the embodiment shown in FIG. 3, an angle formed between the upper panel 22 and the lower panel 24 is less than 90°, and as such is an acute angle, but in other embodiments, the angle may be equal to or greater than 90° (a right or obtuse angle). It should be noted that while the risers are described as having upper and lower or first and second panels that connect with each other along an edge in order to describe portions of the risers, the risers may be fashioned as a single unitary piece, such that the transition between the panels is merely a bend. The risers may be formed by an extruding process or a molding process.

The hook profile 14*a* extends from the first edge 26 of the lower panel 24 of the riser 12*a*. The hook profile 14*a* is shown in FIG. 3 as having been received into a channel of the display module 16. One tab, tab 20*a*, is illustrated here. As mentioned, while the hook profile 14*a* is engaging with the channel, the hook profile 14*a* may compress into a compressed position in order to fit past a lowermost protrusion of the tab 20*a* and into the channel. Alternatively, the tab 20*a* may compress but the hook profile 14*a* may not compress during engagement. Even further, both the tab 20*a* and the hook profile 14*a* may compress or deflect slightly during engagement of the hook profile 14*a* into the channel.

As shown in FIG. 3, the display module is labeled as 16*a*, which is a first portion of the display module 16 of FIG. 1. Additional portions of the display module may be utilized, but for the sake of clarity, just the first portion 16*a* of the display module is shown here. For example, the display module may also comprise a second portion, a third portion, a fourth portion, and so on. The second portion of the display module may be adjacent to or located above the first portion. Accordingly, the third portion may be adjacent to or located above the second portion, etc. The first portion 16*a* of the display module comprises an upper section 28, a middle section 30, and a lower section 32. The upper section 28 has a front surface 38, which faces the rear or back surface 36 of the upper panel 22 of the riser 12*a*. While in one embodiment the front surface 38 of the upper section 28 is substantially parallel to the back surface 36 of the upper panel 22, it is contemplated that other configurations may be utilized. However, not every portion of the display module has to include all three sections. The first portion 16*a* of the display module may have the lower section 32, while other portions of the display module may not. For instance, the first portion 16*a* of the display module is the bottommost portion. However, if more than one riser is utilized, the portion of the display module that corresponds to a second riser, for instance, may have only a first surface and a second surface. This can more clearly be seen in FIG. 5.

FIG. 4 is a perspective view taken more from a rear of the right side of a snap-in card top riser, in accordance with an embodiment of the present invention. This rear view illustrates the riser 12*a* with an upper panel 22 and a lower panel 24. The first or proximal edge 23 of the upper panel 22 is shown and the lower panel 24 extends rearwardly from the first edge 23 of the upper panel 22. The first or distal edge 26 of the lower panel 24 is also shown here. The hook profile 14*a* extends from the first edge 26 of the lower panel 24. The back surface 36 of the upper panel 22 is illustrated. A portion of the display module 16 is illustrated, which includes channels 18*a* and 18*b*, and tabs 20*a* and 20*b*. As illustrated, the channel 18*a* has not yet received the hook profile 14*a* of the riser 12*a*. Accordingly, a portion of the front side of the channel 18*a* is visible through an opening adjacent the tab 20*a*. In contrast, the riser 12*b* is already coupled with the display module 16 (see FIGS. 1 and 2), so the hook profile 14*b* is already received in the channel 18*b* and a portion thereof is visible in an opening adjacent the tab 20*b*. The display module 16 may be formed by a molding process and may include structural ribs 40. The ribs may have openings 42 therein to permit coupling the display module 16 to the metal frames or fixtures (not shown) that support the display modules.

Figure 5:
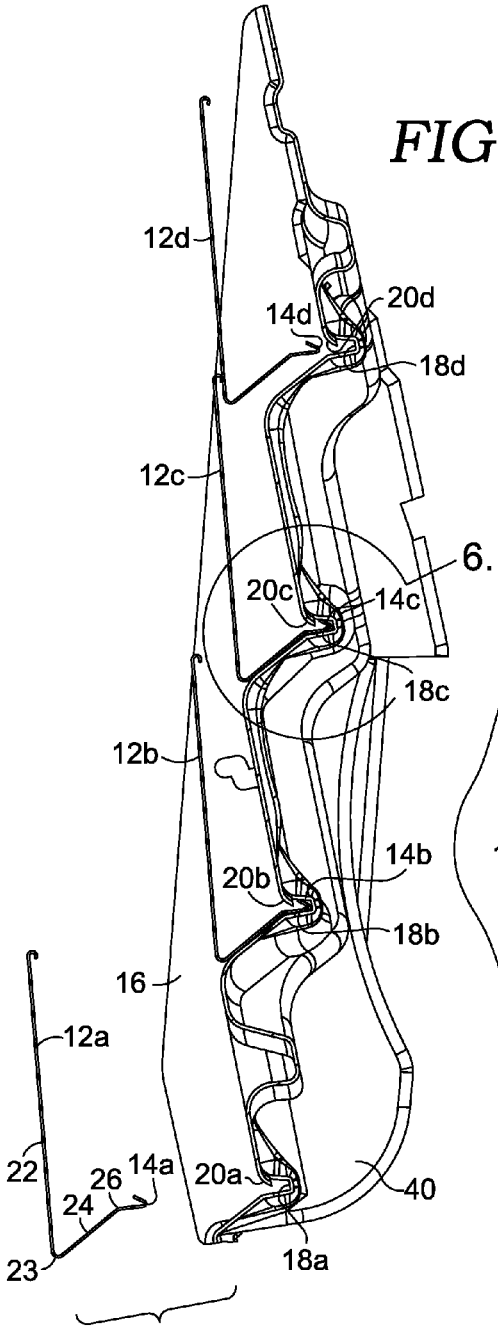

FIG. 5 is a right side elevation cross sectional view of the snap-in card top riser of FIG. 1 taken along the line 5-5, in accordance with an embodiment of the present invention. This figure illustrates riser 12*a* not yet engaged with the display module 16, riser 12*d* that is about to engage with the display module 16, and risers 12*b* and 12*c* that are fully engaged with the display module 16. Upon coupling riser 12*a* to the display module, the hook profile 14*a* will engage with the tab 20*a* and will be received into the channel 18*a*. This allows for the riser 12*a* to be secured to the display module 16. Risers 12*b* and 12*c* are illustrated as already being fully engaged with the display module 16, and thus the risers 12*b* and 12*c* are be locked into position and as such should remain in that position relative to the display module 16 until the risers 12*b* and 12*c* are removed from the display module 16. The hook profiles 14*b* and 14*c* of the risers 12*b* and 12*c*, respectively, engage with the channels 18*b* and 18*c*, respectively, by first engaging with at least the tabs 20*b* and 20*c*, respectively. As such, during engagement, the tabs 20*b* and 20*c*, the hook profiles 14*b* and 14*c*, or both, would have compressed in order for the hook profiles 14*b* and 14*c* to fit into the channels 18*b* and 18*c*. As shown here, once the hook profiles 14*b* and 14*c* have been received into the channels 18*b* and 18*c*, respectively, the hook profiles 14*b* and 14*c* return to their original or uncompressed position.

The riser 12*d* is shown in FIG. 5 as not having yet been engaged with the display module 16. The hook profile 14*d* will make physical contact with the tab 20*d*, where one or more of the hook profile 14*d* or the tab 20*d* will be forced to compress, thus allowing the hook profile 14*d* to be received into the channel 18*d*. The compression may occur as a result of a manual force exerted on the riser 12*d* in the direction toward the display module 16 to force the hook profile 14*d* into the channel 18*d*. Once the riser 12*d* is received into the channel 18*d*, the card top riser is able to hold greeting cards or other items for display to consumers.

Figure 6:
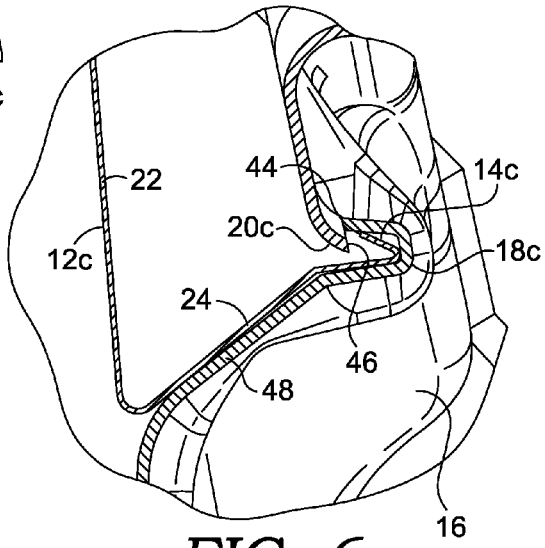

Turing to FIG. 6, an enlarged fragmentary view of a portion of the snap-in card top riser of FIG. 5 in the area 6 is depicted, in accordance with an embodiment of the present invention. The riser 12*c* has the hook profile 14*c* that has been received in the channel 18*c* of the display module 16. For instance, force may have been applied to the riser 12*c* against the display module 16 so that the tab 20*c*, the hook profile 14*c*, or both were compressed as the hook profile 14*c* was being received into the channel 18*c*. Once received, the riser 12*c* is secured to the display module 16. In one embodiment, when the riser 12*c* is secured to the display module 16, the riser 12*c* is locked or held into place, and remains in a substantially consistent position, or stationary, relative to the display module 16. For example, when the ends of the display module are in place, the riser 12*c* and other risers may be unable to move laterally, as they are constrained by the ends. In an alternative embodiment, however, the riser 12*c* and other risers discussed herein may be slidably engaged with the display module when the riser has been received into the channel. As such, in this embodiment, the riser is configured to slide longitudinally along the channel when the riser is secured to the display module. This alternative embodiment may occur if the ends of the display module are removable and are removed for removal of the risers. In another embodiment, the channels may include vertical ribs therein and the hook profiles of the risers may include corresponding cutouts 39 (best seen in FIG. 4) so the cutouts 39 are received around the ribs and the ribs prevent lateral movement of the riser.

As best seen in FIG. 6, the hook profile is preferably a portion of the distal or first edge 26 of the lower panel 24 that is turned back toward the upper panel 22, such that an outer edge 44 of the riser engages a rear facing portion 46 of the tab 20 when the hook portion 14 is received in the channel. The bend that forms the turned back portion provides a natural spring-like resilience to the hook portion 14 that permits the turned back portion to be deflected downwardly when it is pressed pass and engages with the tab 20 and bounce back to the rest position illustrated in FIG. 6 when the outer edge 44 moves past the tab 20 and is fully received in the channel 18.

As also best seen in FIG. 6, a shelf portion 48 of the display module 16 helps support the riser when it is coupled with the display module 16. In use, when the hook portion is received in the channel, the lower panel 24 of the riser 12 rests on the shelf portion 48 of the display module 16 and downward forces on the riser (from cards received therein or users pulling downwardly or forwardly on the riser to get cards out) are transferred to the display module. When the upper panel 22 is rotated forwardly, the shelf portion supports the weight and the turned back portion of the hook portion 14 engages an upper wall of the channel 18.

In one embodiment, the risers and the display module are vacuum formed, and thus may be constructed from plastic that is heated to a forming temperature, and stretched onto or into a mold. The plastic is forced against the mold by a vacuum. The particular type of plastic used may be dependent upon the process used, but may include, for example, thermoplastics, such as high impact polystyrene sheeting (HIPS). In embodiments, the vacuum forming allows the material used to be thinner, thus reducing overall costs of the card display modules. Risers made using this design may not require secondary trimming, while the molds used to produce the vacuum formed display modules may not require moving sections or flipper mechanisms. Other types of plastic are contemplated to be within the scope of aspects of the present invention. Further, one or both of the riser or the display module may be constructed from some other material, including metal, wood, or the like.

Many variations can be made to the illustrated embodiment of the present invention without departing from the scope of the present invention. Such modifications are within the scope of the present invention. For example, while the risers have been illustrated as having the hook profile run the entire width of the riser, the hook profile may be used in multiple sections and not in other sections.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and subcombinations are of utility and may be employed without reference to other features and subcombinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A snap-in card top riser comprising:

a riser having a hook profile; and a display module having a channel, the channel having one or more walls and a channel opening, the channel is adapted to receive the hook profile in the channel opening and to secure the riser to the display module by receiving the hook profile in one or more openings formed through the one or more walls of the channel, wherein the channel has one or more tabs associated with the one or more openings that are configured to cause one or both of the hook profile or the one or more tabs to compress while the one or more tabs are engaging with the hook profile, and wherein the hook profile returns and/or the one or more tabs return to an uncompressed position when the hook profile is fully received into the channel and one or more openings.

2. The snap-in card top riser of claim 1, wherein when the riser is secured to the display module, the riser remains in a substantially consistent location front to back and up and down relative to the display module.

3. The snap-in card top riser of claim 1, wherein the riser comprises an upper panel and a lower panel that extends rearwardly from the upper panel.

4. The snap-in card top riser of claim 3, wherein the upper panel of the riser has a first or proximal edge, and wherein the lower panel of the riser has a first or distal edge, wherein the hook profile extends from the first or distal edge of the lower panel.

5. The snap-in card top riser of claim 1, wherein the display module comprises, at least, a first portion, the first portion comprising an upper section and a middle section, and wherein the channel is formed at an intersection of the upper section and the middle section.

6. The snap-in card top riser of claim 5, wherein the first portion of the display module further comprises a lower section.

7. The snap-in card top riser of claim 1, wherein the riser and the display module, when secured to one another, provide for a display of greeting cards.

8. The snap-in card top riser of claim 1, wherein the riser is a first riser having a first hook profile, and wherein the snap-in card top riser further comprises a second riser having a second hook profile.

9. The snap-in card top riser of claim 8, wherein the channel of the display module is a first channel, and wherein the display module further comprises a second channel into which the second hook profile is received.

10. The snap-in card top riser of claim 9, wherein the one or more tabs of the first channel are a first set of tabs, and wherein the second channel comprises a second set of tabs that engage with the second hook profile that compresses while the one or more tabs are engaging with the second hook profile.

11. A snap-in card top riser comprising:

a riser having an upper panel and a lower panel, the lower panel extending from a first edge of the upper panel, the lower panel having a first edge from which a hook profile extends, where a portion of the hook profile bends back and returns toward the upper panel; and a display module having at least an upper section, a middle section, and a channel that is formed at an intersection of the upper section and the middle section, the channel having one or more grooves formed therein and one or more openings formed through the display module at the grooves, wherein a part of the one or more grooves is trimmed by the one or more openings formed through the display module to create one or more tabs, wherein the channel is configured to receive the hook profile, wherein the hook profile is configured to compress when engaging with the one or more tabs of the channel, and wherein the hook profile returns to an original position when fully engaged with the channel and received in the one or more openings.

12. The snap-in card top riser of claim 11, wherein the riser is slidably engaged with the display module when the riser is received into the channel.

13. The snap-in card top riser of claim 11, wherein the riser is secured to the display module when the hook profile is fully engaged with the channel.

14. The snap-in card top riser of claim 13, wherein movement of the riser away from the display module is restricted when the riser is secured to the display module and wherein the lower panel rests on the middle section when the riser is secured to the display module.

15. A snap-in card top riser comprising:

a riser having a hook profile along a rearward edge; and a display module having a lateral and generally horizontal channel that is adapted to receive the hook profile, wherein the channel has one of more grooves formed therein, and wherein the display module has one or more openings extending therethrough at the one or more grooves to form one or more tabs within the channel, wherein one or more portions of the hook profile are received in the one or more openings, and wherein the one or more tabs cooperate with the hook profile to couple the riser to the display module.

16. The snap-in card top riser of claim 15, wherein the one or more tabs are also configured to compress when the hook profile is engaging with the one or more tabs.

17. The snap-in card top riser of claim 15, wherein the riser is secured to the display module when the hook profile is received into the channel.

18. The snap-in card top riser of claim 15, wherein when the riser is secured to the display module, the riser remains in a substantially consistent location relative to the display module.

19. The snap-in card top riser of claim 15, wherein the channel includes one or more vertical ribs therein, wherein the hook profile includes one or more cutouts, wherein the one or more vertical ribs are received in the one or more cutouts when the hook profile is received in the channel, and wherein the one or more vertical ribs cooperate with the one or more cutouts to restrict lateral movement of the riser with respect to the display module.

* * * * *